US009310067B2

(12) United States Patent
Abernethy

(10) Patent No.: US 9,310,067 B2
(45) Date of Patent: Apr. 12, 2016

(54) SYSTEMS, DEVICES AND/OR METHODS FOR MANAGING ILLUMINATION

(71) Applicant: Alfred Campbell Abernethy, Waynesboro, VA (US)

(72) Inventor: Alfred Campbell Abernethy, Waynesboro, VA (US)

( * ) Notice: Subject to any disclaimer, the term of this patent is extended or adjusted under 35 U.S.C. 154(b) by 0 days.

(21) Appl. No.: 14/197,835

(22) Filed: Mar. 5, 2014

(65) Prior Publication Data

US 2015/0253000 A1 Sep. 10, 2015

Related U.S. Application Data

(60) Provisional application No. 61/808,119, filed on Apr. 3, 2013.

(51) Int. Cl.

| | |
|---|---|
| ***F21L 4/00*** | (2006.01) |
| ***F21V 31/00*** | (2006.01) |
| ***F21K 99/00*** | (2010.01) |
| ***F21L 4/08*** | (2006.01) |
| *F21Y 103/00* | (2006.01) |
| *F21W 131/401* | (2006.01) |

(52) U.S. Cl.

CPC . *F21V 31/00* (2013.01); *F21K 9/30* (2013.01); *F21L 4/00* (2013.01); *F21L 4/08* (2013.01); *F21W 2131/401* (2013.01); *F21Y 2103/003* (2013.01)

(58) Field of Classification Search

CPC ..... G02B 6/001; G02B 6/005; G02B 6/0071; F21S 48/33; F21V 31/00; F21V 31/005; F21L 4/08; F21Y 2101/02; F21W 2111/10; F21W 2111/047; F21K 9/30

USPC ..... 362/158, 581, 120; 43/17.5

See application file for complete search history.

(56) References Cited

U.S. PATENT DOCUMENTS

| | | | | |
|---|---|---|---|---|
| 5,688,042 | A * | 11/1997 | Madadi et al. | 362/240 |
| 5,765,941 | A * | 6/1998 | Vest | 362/260 |
| 8,029,159 | B2 * | 10/2011 | Chen | 362/249.1 |
| 8,070,347 | B1 | 12/2011 | Lin | |
| 8,888,315 | B2 * | 11/2014 | Edwards et al. | 362/223 |
| 2005/0068790 | A1 | 3/2005 | Love | |
| 2006/0082988 | A1 * | 4/2006 | Riblett et al. | 362/120 |
| 2007/0268702 | A1 * | 11/2007 | McFadden | 362/294 |
| 2011/0058367 | A1 * | 3/2011 | Shiau et al. | 362/218 |
| 2011/0182059 | A1 * | 7/2011 | Liu | 362/158 |
| 2012/0206908 | A1 * | 8/2012 | Riley et al. | 362/183 |
| 2013/0170180 | A1 | 7/2013 | Lee | |
| 2013/0215614 | A1 | 8/2013 | Gulden | |

* cited by examiner

*Primary Examiner* — Evan Dzierzynski
*Assistant Examiner* — Matthew Peerce
(74) *Attorney, Agent, or Firm* — Dale Jensen, PLC; Dale Jensen

(57) ABSTRACT

Certain exemplary embodiments can provide a system comprising a housing having a first end and a second end, a first set of light emitting diodes, and a channel coupled to the set of light emitting diodes. The channel can comprise a surface to mount the set of light emitting diodes.

17 Claims, 5 Drawing Sheets

2000

1000

2000

SYSTEMS, DEVICES AND/OR METHODS FOR MANAGING ILLUMINATION

CROSS-REFERENCES TO RELATED APPLICATIONS

This application claims priority to, and incorporates by reference herein in its entirety, U.S. Provisional Patent Application Ser. No. 61/808,119, filed 3 Apr. 2013.

BRIEF DESCRIPTION OF THE DRAWINGS

A wide variety of potential practical and useful embodiments will be more readily understood through the following detailed description of certain exemplary embodiments, with reference to the accompanying exemplary drawings in which.

DETAILED DESCRIPTION

Certain exemplary embodiments can provide a system comprising a housing having a first end and a second end, a first set of light emitting diodes, and a channel coupled to the set of light emitting diodes. The channel can comprise a surface to mount the set of light emitting diodes.

Figure 1:
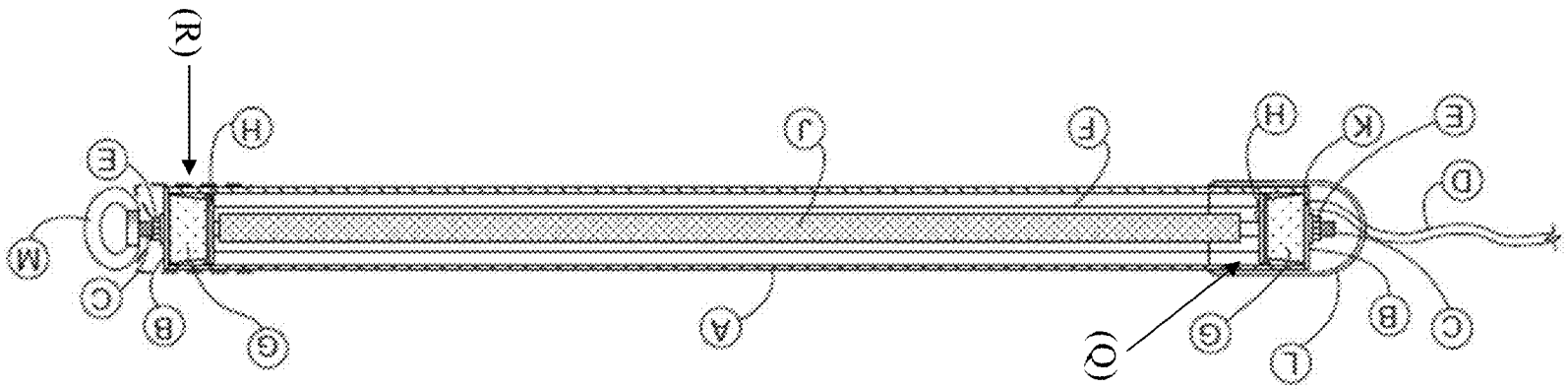
FIG. 1 is a side view of an exemplary embodiment of a system 1000.

FIG. 1 is a side view of an exemplary embodiment of a system 1000, which is a substantially waterproof light emitting diode ("LED") tube light. System 1000 can have multiple applications such as, for example, providing: room or work area lighting, buoy lights in the water, pool lighting, underwater and boating lighting, dock lighting, outside lighting, and/or industrial and hazardous area lighting, etc. System 1000, which can be substantially waterproof, can be used in dry, wet, and/or underwater environments.

Certain exemplary embodiments comprise first set of LEDs (J), which can be one of a plurality of sets of LEDs, inside an impact resistant, translucent or transparent housing (A), which can be a tube. System 1000 can offer great durability, operational life, with luminosity as compared to certain alternative lighting systems.

In certain exemplary embodiments, first set of LEDs (J) can provide approximately 180 degrees of light per strip. Certain exemplary embodiments can comprise first set of LEDs (J) on all sides of a center channel (F), which can have a substantially square cross-section, to provide approximately 360 degrees of lighting around system 1000. Certain exemplary embodiments comprise a relatively small number of parts.

Substantially waterproof LED system 1000 can be battery operated or externally powered AC or DC power sources such as via cord (D). Waterproof characteristics of system 1000 can be enhanced via using a stopper (G), which can be tapered and can comprise silicone or rubber, at each end of housing (A). Stopper (G) can be sized to seal on the inside diameter of each end of housing (A) and thereby resist the penetration of water into housing (A).

The center channel (F) functions include:

- as a surface to mount for first set of LEDs (J);
- as a brace between a stopper (G) at each end of system 1000;
- to keep stopper (G) from being pushed into the housing (A) during times when system 1000 is used in higher ambient pressure applications such as underwater;
- as a battery holder (e.g., a battery can be inside channel (F));
- to protect the wiring from heat generated from first set of LEDs (J);
- to partially enclose ballast weights (e.g., the ballast weights can be placed inside channel (F)) when used in underwater applications; and/or
- to add rigidity and strength to resist bending the of the tube light assembly; etc.

Washer (H) can be installed between center channel (F) and stopper (G) and can provide a relatively smooth bearing surface which can improve sealing of stopper (G) when system 1000 is used in higher ambient pressure applications such as underwater. Stopper (G) can be compressed in place which improves sealing on the inside diameter of housing (A).

In certain exemplary embodiments, stopper (G) at one end of system 1000 can define a cord aperture (K) for when an external power supply cable is used. Sealing improves around a cord (D) when the ambient pressure is higher external to the tube such as in underwater applications because of the compression of stopper (G) around cord (D).

End cap washer (B) can be used to:

- protect the tube ends from damage;
- protect stopper (G) from damage; and/or
- as a part of a clamp for the entire assembly when used with center shaft (C) (which can be threaded entirely or at each end) and nut (E); etc.

Center shaft (C), which can be threaded, runs substantially the length of system 1000 and functions:

- as part of the clamp to protect the ends of the tube light assembly and for added rigidity and strength to prevent bending the of the tube light assembly; and/or
- as a threaded mount at each end of system 1000 for mounting accessories such as threaded eye nut (M), hooks, camera mounts, and/or other fixtures; etc.

Protective end cap (L), which can be slidably coupled to housing (A), can provide additional protection to the ends of the tube when used in hazardous environments. Protective end cap (L) can also compress and have an access hole for the threaded rod (C) to allow for attachment of mounting accessories such as threaded eye nut (M) as shown FIG. 1. Multiple end caps (L) can be used for added protection of ends.

Housing (A) can be substantially transparent or can have a colored tint for use in warning boats or people; night lighting; and/or other applications.

A tube light assembly, such as system 1000, can be buoyant (and float) and/or ballast weights can be added inside channel (F) at one end to make system 1000 float vertically. Housing (A) can be substantially cylindrical for strength and for substantially even distribution of outside forces such as water pressure. A substantially waterproof LED Tube Light assembly, such as system 1000, can be any length.

Housing (A) can comprise a first end (Q) and a second end (R). Channel (F) can be coupled to first set of light emitting diodes (J). Channel (F) can comprise a surface (S) (illustrated in system 2000 of FIG. 2) adapted to be coupled to first set of light emitting diodes (J). Channel (F) can be adapted to thermally insulate wiring of system 1000 and first set of light emitting diodes (J) of system 1000 from heat generated via first set of light emitting diodes (J). Channel (F) can be adapted to resist bending when forces are applied to system 1000. A second set of light emitting diodes (P) can be coupled to channel (F) as illustrated in system 2000 of FIG. 2.

Center shaft (C), which can be threaded, can be adapted to fit through channel (F) and extend beyond ends (Q) and (R) of housing (A). Center shaft (C) can be adapted to resist bending when forces are applied to system 1000. Center shaft (C) can be adapted to isolate end lifting forces to system 1000. When system 1000 is used in-line with a cable or chain attached to one or both ends, the lifting forces from the cable or chain are applied at the points of attachment of the cable or chain to center shaft (C). In such embodiments, the forces are transmitted from one end of center shaft (C) to the other, but this will not affect the operation of the light. Certain exemplary embodiments can operate as a "link in chain" of tube lights.

Stopper (G), which can be one of an opposing pair of stoppers installed on respective ends of system 1000, as illustrated, can be adapted to substantially surround a first threaded end of center shaft (C). Stopper (G) can be adapted to plug first end (Q) of housing (A) and resist the penetration of water into housing (A). Channel (F) can be adapted to brace stopper (G) and to resist motion of stopper (G) when system 1000 is under water.

Washer (H) can have a same shape as a cross section of housing (A) (e.g., a round shape) and placed over an end of center shaft (C). Washer (H) held onto the ends of system 1000 via a nut (E), which can be threaded, coupled to an end of threaded center shaft (C). Protective end cap (L) can be adapted to resist penetration of water into housing (A) and can shield ends of system 1000 when system 1000 comes into contact with another object.

Cord (D) can penetrate through a single end of system 1000 and can be a adapted to supply power to first set of light emitting diodes (J) or to charge a battery of system 1000. In certain exemplary embodiments, system 1000 can comprise ballast weights, which can be partially surrounded by channel (F) (e.g., in a void defined by channel (F)). The ballast weights can be adapted to cause system 1000 to sink or float in a substantially vertical orientation when placed in water or float vertically.

System 1000 can comprise a pair of washers (in FIG. 1 (B) designates each of the pair of washers, each of which is installed on an opposing end of housing (A)). Each of the pair of washers can adapted to be installed between an end of channel (F) and stopper (G). Each of the pair of washers can be adapted to provide a bearing surface to improve sealing of the stoppers when system 1000 is underwater. Certain exemplary embodiments can comprise a battery adapted to provide power to first set of LEDs (J). In certain exemplary embodiments, channel (F) can be adapted to hold the battery.

Stopper (G) can define a cord aperture. The cord aperture can be adapted to substantially surround a portion of cord (D) and seal around the portion of cord (D). Center shaft (C) can comprise threaded ends. The threaded ends can be adapted to be coupled to mounting accessories such as threaded eye nut (M), hooks, camera mounts, and/or other fixtures, etc.

System 1000 can be adapted for use as a buoy light in water, an underwater light, a swimming pool light, a confined space light, and/or an outdoor light, etc.

In certain exemplary embodiments, housing (A) can be substantially transparent. Center shaft (C) can comprise threaded ends. At least one of the threaded ends can be adapted to be coupled to an eye nut, such as eye nut (M). Eye nut (M) can be adapted for lifting, hanging, or mounting system 1000. In other embodiments, At least one of the threaded ends can be adapted to be coupled to a hook adapted for lifting, hanging, or mounting system 1000. In other embodiments, one or more threaded ends of center shaft (C) can be adapted to be coupled to a pedestal plate (N) (illustrated in system 3000 of FIG. 3). Pedestal plate (N) can be adapted for vertical positioning system 1000 on a substantially flat surface.

Figure 2:
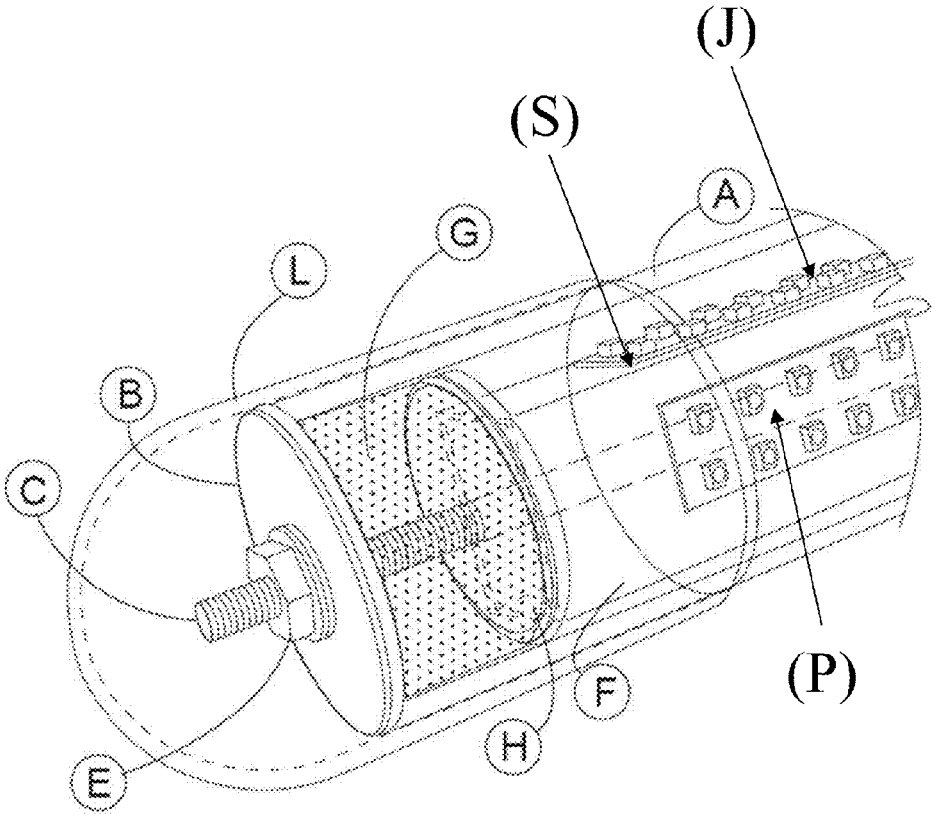
FIG. 2 is a perspective view of an exemplary embodiment of a portion of a system 2000.

FIG. 2 is a perspective view of an exemplary embodiment of a portion of a system 2000, which can comprise housing (A), end cap washers (B), center shaft (C), nut (E), channel (F), silicone or rubber stopper (G), washer (H), first set of LEDs (J), a protective end cap (L), a second set of LEDs (P), and a surface (S) of channel (F).

Figure 3:
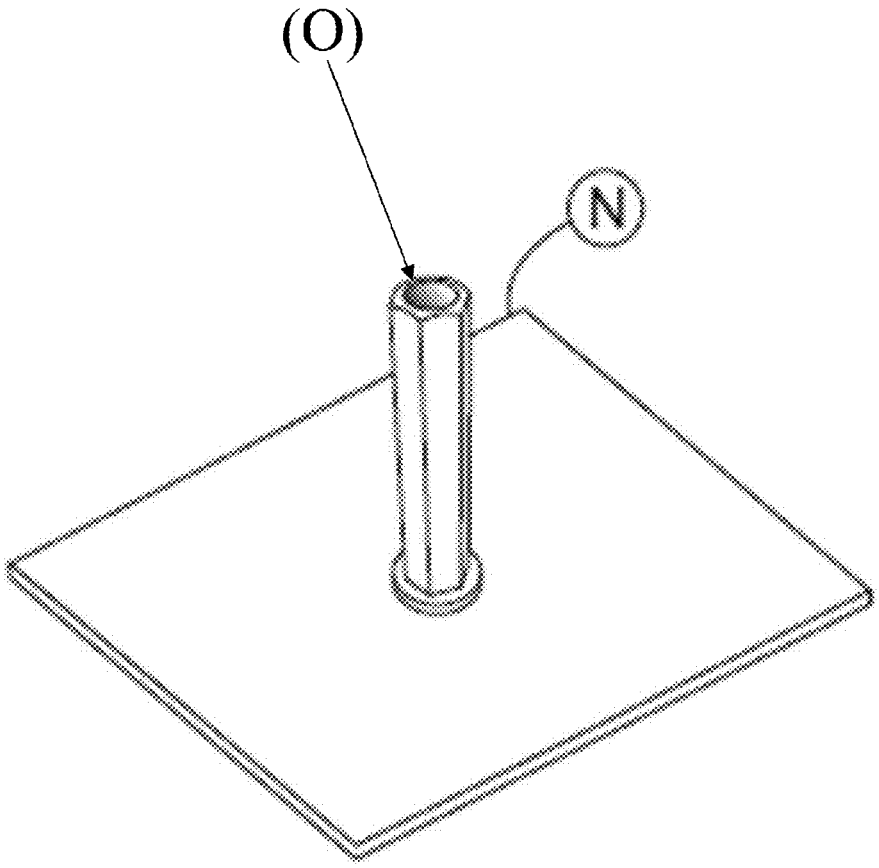
FIG. 3 is a perspective view of an exemplary embodiment of a system 3000.

FIG. 3 is a perspective view of an exemplary embodiment of a system 3000, which can comprise a light holder (O) and a pedestal plate (N). In certain exemplary embodiments, system 3000 can be coupled to a tube light assembly, such as system 1000 of FIG. 1. In certain exemplary embodiments, light holder (O) can be coupled to center shaft (C) of certain tube lights. In other embodiments, an attachment can be coupled to system 1000 of FIG. 1 instead of threaded eye nut (M), which attachment can be adapted to engage with light holder (O) to mount system 1000 of FIG. 1 to system 3000. Pedestal plate (N) can be adapted to provide a relatively stable base to retain a tube light system in a substantially fixed position on a surface, such as a substantially flat surface.

Figure 4:
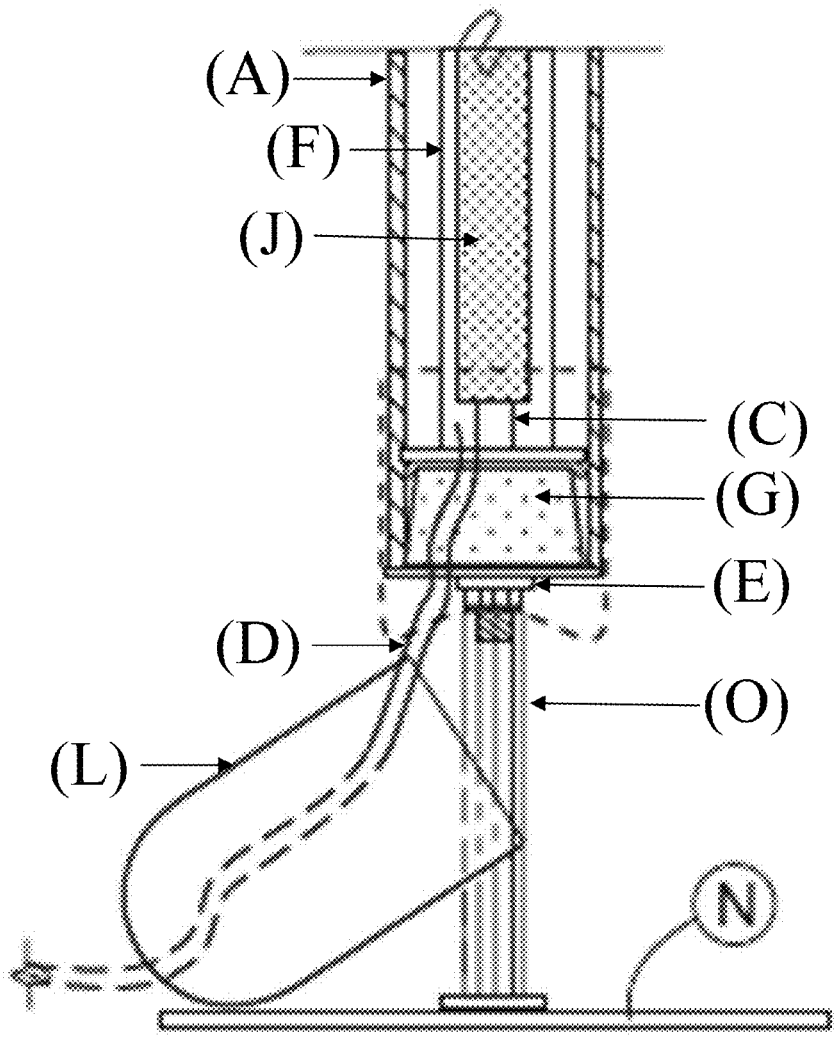
FIG. 4 is a partial side view of an exemplary embodiment of a system 4000.

FIG. 4 is a partial side view of an exemplary embodiment of a system 4000, which can comprise housing (A), center shaft (C), cord (D), nut (E), channel (F), stopper (G), first set of LEDs (J), protective end cap (L), light holder (O), and pedestal plate (N). System 4000 illustrates an embodiment wherein a tube light system is coupled to a light holder (O) and a pedestal plate (N) as illustrated in system 3000 of FIG. 3. In such embodiments, light holder (O) can be threaded to be coupled via threads to the tube light system.

Figure 5:
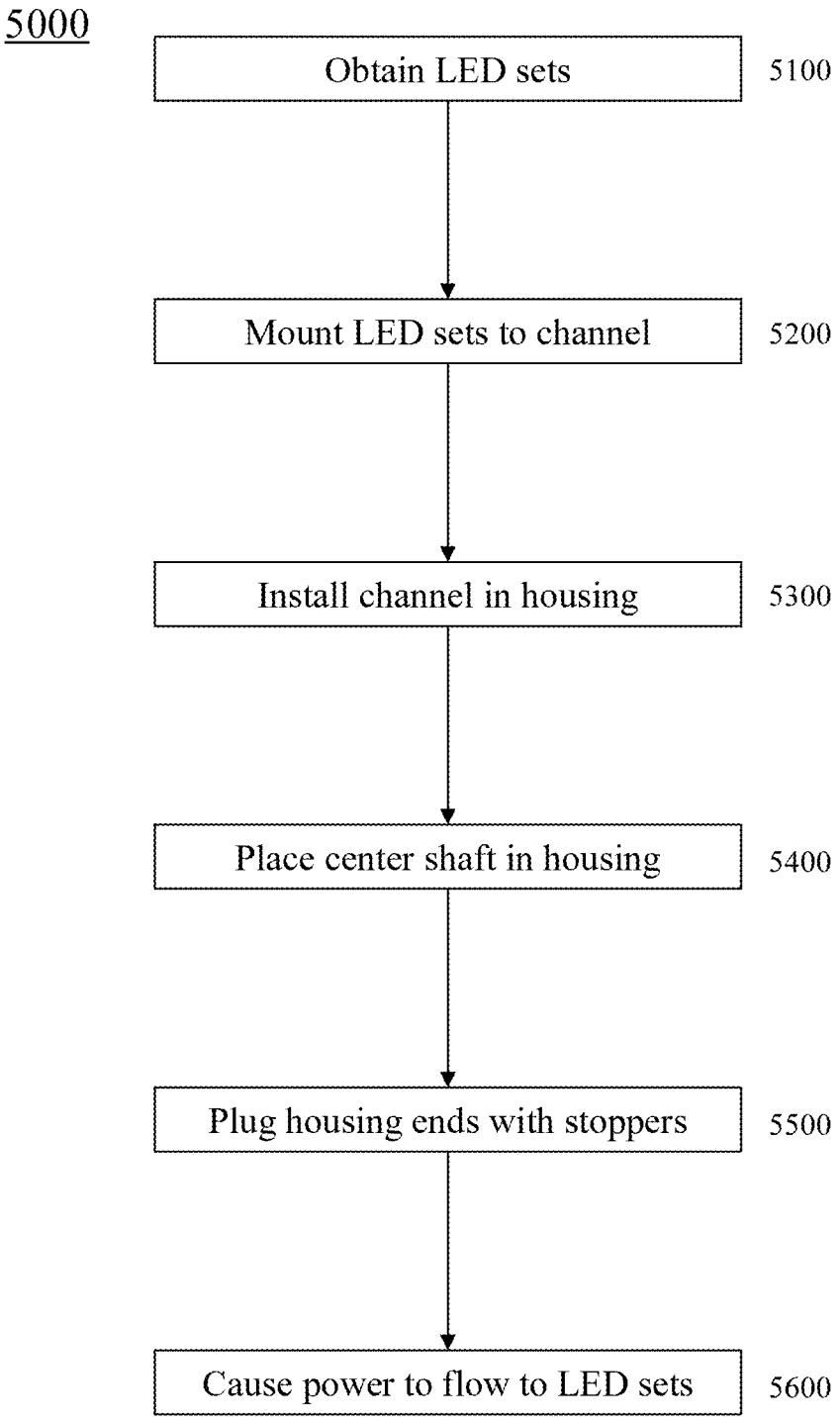
FIG. 5 is a flow diagram of an exemplary embodiment of a method 5000.

FIG. 5 is a flowchart of an exemplary embodiment of a method 5000. At activity 5100, LED sets can be obtained. The LED sets can be individual LEDs and/or prefabricated LED strips. At activity 5200, the LED sets can be mounted to a channel. The channel can be adapted to mount a plurality of LED sets to provide illumination to an area surrounding the channel. At activity 5300, the channel can be installed in the housing. At activity 5400, a center shaft can be installed in the housing and/or slidably placed inside of the channel. The center shaft can be threaded on both ends and can be coupled to end caps of a tube light. At activity 5500, housing ends can be plugged with stoppers. The stoppers in conjunction with a housing of the tube light can be adapted to render the tube light water resistant and/or substantially waterproof. At activity 5600, power can be caused to flow to the LED sets thereby illuminating an area surrounding the tube light.

The word "sets" is used as a reference to groups of LEDs. Exemplary embodiments are not limited to sets but instead by the surface area of the channel. As many LEDs as desired can be mounted to the channel in any configuration desired to achieve illumination objectives.

Definitions

When the following terms are used substantively herein, the accompanying definitions apply. These terms and definitions are presented without prejudice, and, consistent with the application, the right to redefine these terms during the prosecution of this application or any application claiming priority hereto is reserved. For the purpose of interpreting a claim of any patent that claims priority hereto, each definition (or redefined term if an original definition was amended during the prosecution of that patent), functions as a clear and unambiguous disavowal of the subject matter outside of that definition.

a—at least one.
activity—an action, act, step, and/or process or portion thereof.
adapted to—made suitable or fit for a specific use or situation.
adapter—a device used to effect operative compatibility between different parts of one or more pieces of an apparatus or system.
and/or—either in conjunction with or in alternative to.
aperture—an opening.
apparatus—an appliance or device for a particular purpose.
ballast—a material added to a system to increase weight of the system and/or to provide stability and floating position of the system.
battery—an electrochemical system adapted to provide an electrical direct current.
bear—to support a weight of.
bend—to deform from an original shape.
brace—to strengthen and/or support.
buoy—an object that floats in water.
camera—a system adapted to capture an image of a viewed object or scene.
can—is capable of, in at least some embodiments.
cap—a cover.
center—having a location in a system with a substantially round cross-section that is approximately equally distant from all points on the circumference of the substantially round cross-section.
channel—a structural member having a substantially square or substantially round cross-section.
charge—to add electrical energy.
comprising—including but not limited to.
confined space—a substantially enclosed volume having one or more points of ingress and egress.
connect—to join or fasten together.
cord—a flexible insulated cable adapted to convey electrical energy.
couple—to link in some fashion.
coupleable—capable of being joined, connected, and/or linked together.
cross-section—a section made by a plane cutting something transversely.
define—to establish the outline, form, or structure of.
device—a machine, manufacture, and/or collection thereof.
end—an extremity of an object.
extend—to exist.
eye nut—a nut that comprises a looped portion adapted to lift hang or mount something coupled to the eye nut.
fit—having a proper size or shape.
flat—substantially planar.
float—to rest or move on a liquid surface substantially without sinking.
force—a dynamic influence that changes a body from a state of rest to one of motion or changes its rate of motion.
generate—to produce.
heat—energy that increases the temperature of something.
held—supported.
hold—to support.
hook—a curved or angular piece of a hard substance adapted for catching, pulling, holding, or suspending something.
housing—a container adapted to resist environmental elements from direct contact with something.
install—to place in position for use.
insulate—to cover in a manner so as to reduce heat energy transfer.
lift—to vertically displace.
light—illumination.
light emitting diode—a diode of semiconductor material that emits light when an electrical bias is applied.
may—is allowed and/or permitted to, in at least some embodiments.
method—a process, procedure, and/or collection of related activities for accomplishing something.
motion—displacement of something from a first location to a second location.
mount—a device or system adapted to provide support for, and be coupled to, something.
nut—a threaded fastener adapted to be coupled to a threaded shaft or stud.
outdoor lighting—systems adapted to provide illumination in a substantially unenclosed environment unsheltered earthly elements.
pedestal—a structural base adapted to support something.
penetrate—to enter something.
place—to position something in a location.
plate—a substantially flat sheet of a substance.
plug—to substantially fill an opening.
plurality—the state of being plural and/or more than one.
position—to place in a location.
power—electrical energy.
predetermined—established in advance.
protective—having a quality or function to resist damage.
provide—to furnish, supply, give, and/or make available.
relative—with relation to.
resist—to inhibit to some degree.
restrain—to impair to some degree.
seal—to fill an opening in a manner to substantially prevent transfer of liquids or gases through the opening.
set—a related plurality.
shaft—a substantially straight member with a substantially round cross-section.
shield—to resist contact or damage.
sink—to displace a volume of water and become submerged in water.
square—rectangular with a length approximately equal to width.
stopper—elastic material used to seal an end of a tube.
substantially—to a great extent or degree.
supply—to provide.
support—to bear the weight of, especially from below.
surface—an outermost layer of something.
surround—substantially encompass.
swimming pool—a basin that can be filled with water and designated for people to swim.
system—a collection of mechanisms, devices, machines, articles of manufacture, processes, data, and/or instructions, the collection designed to perform one or more specific functions.
thermally—caused by heat or temperature.
threaded—having helical grooves adapted to be coupled to something with corresponding helical grooves.
transparent—something having a property that allows rays of light to pass through its substance so that a human can see objects beyond or behind.
underwater—submerged.
vertically—being in a position or direction perpendicular to a plane of a horizon.

via—by way of and/or utilizing.

washer—an annular object used to give tightness to a joint, to prevent leakage, and/or to distribute pressure, etc.

weight—a value indicative of importance.

wiring—electrically conductive substances.

Note

Still other substantially and specifically practical and useful embodiments will become readily apparent to those skilled in this art from reading the above-recited and/or herein-included detailed description and/or drawings of certain exemplary embodiments. It should be understood that numerous variations, modifications, and additional embodiments are possible, and accordingly, all such variations, modifications, and embodiments are to be regarded as being within the scope of this application.

Thus, regardless of the content of any portion (e.g., title, field, background, summary, description, abstract, drawing figure, etc.) of this application, unless clearly specified to the contrary, such as via explicit definition, assertion, or argument, with respect to any claim, whether of this application and/or any claim of any application claiming priority hereto, and whether originally presented or otherwise:

there is no requirement for the inclusion of any particular described or illustrated characteristic, function, activity, or element, any particular sequence of activities, or any particular interrelationship of elements;

no characteristic, function, activity, or element is "essential";

any elements can be integrated, segregated, and/or duplicated;

any activity can be repeated, any activity can be performed by multiple entities, and/or any activity can be performed in multiple jurisdictions; and any activity or element can be specifically excluded, the sequence of activities can vary, and/or the interrelationship of elements can vary.

Moreover, when any number or range is described herein, unless clearly stated otherwise, that number or range is approximate. When any range is described herein, unless clearly stated otherwise, that range includes all values therein and all subranges therein. For example, if a range of 1 to 10 is described, that range includes all values therebetween, such as for example, 1.1, 2.5, 3.335, 5, 6.179, 8.9999, etc., and includes all subranges therebetween, such as for example, 1 to 3.65, 2.8 to 8.14, 1.93 to 9, etc.

When any claim element is followed by a drawing element number, that drawing element number is exemplary and non-limiting on claim scope. No claim of this application is intended to invoke paragraph six of 35 USC 112 unless the precise phrase "means for" is followed by a gerund.

Any information in any material (e.g., a United States patent, United States patent application, book, article, etc.) that has been incorporated by reference herein, is only incorporated by reference to the extent that no conflict exists between such information and the other statements and drawings set forth herein. In the event of such conflict, including a conflict that would render invalid any claim herein or seeking priority hereto, then any such conflicting information in such material is specifically not incorporated by reference herein.

Accordingly, every portion (e.g., title, field, background, summary, description, abstract, drawing figure, etc.) of this application, other than the claims themselves, is to be regarded as illustrative in nature, and not as restrictive, and the scope of subject matter protected by any patent that issues based on this application is defined only by the claims of that patent.

What is claimed is:

1. A system comprising:

a housing having a first end and a second end;

a first set of light emitting diodes;

a channel coupled to said first set of light emitting diodes, said channel comprising a surface to be coupled to said first set of light emitting diodes, said channel adapted to thermally insulate wiring of said system from heat generated via said first set of light emitting diodes, said channel adapted to resist bending when forces are applied to said system;

a threaded center shaft, said center shaft adapted to fit through said channel and extends beyond said ends of said housing; said center shaft adapted to resist bending when forces are applied to said system; said center shaft adapted to isolate end lifting forces to said system when a chain or cable is coupled to said center shaft;

a first stopper, said first stopper adapted to substantially surround a first threaded end of said center shaft, said first stopper adapted to plug said first end of said housing and resist penetration of water into said housing;

a second stopper, said second stopper adapted to substantially surround a second threaded end of said center shaft, said second stopper adapted to plug said second end of said housing and resist penetration of water into said housing, said channel adapted to brace said first stopper and said second stopper and to resist motion of said stoppers when said system is under water; and a washer, said washer having a same shape as a cross section of said housing and placed over an end of said center shaft, said washer coupled to said system via a threaded nut coupled to said first threaded end of said center shaft;

a protective end cap, said protective end cap adapted to resist penetration of water into said housing and shield ends of said system when said system comes into contact with another object.

2. The system of claim 1, further comprising:

a cord penetrating through a single end of said system, said cord adapted to supply power to said first set of light emitting diodes or to charge a battery of said system.

3. The system of claim 1, further comprising:

a second set of light emitting diodes, said second set of light emitting diodes coupled to said channel.

4. The system of claim 1, further comprising:

ballast weights, said ballast weights partially surrounded said channel, said ballast weights adapted to cause said system to sink when placed in water or float vertically.

5. The system of claim 1, further comprising:

a pair of washers, each of said pair of washers adapted to be installed between an end of said channel and one of said stoppers, each of said pair of washers adapted to provide a bearing surface to improve sealing of one of said stoppers when said system is underwater.

6. The system of claim 1, further comprising:

a battery, said channel adapted to hold said battery.

7. The system of claim 1, wherein:

said first stopper defines a cord aperture, said cord aperture adapted to substantially surround a portion of a power cord and seal around said portion of said power cord.

8. The system of claim 1, wherein: one of said threaded ends of said center shaft is adapted to be coupled to a camera.

9. The system of claim 1, wherein:

said system is adapted for use as a buoy light in water.

10. The system of claim 1, wherein:

said system is adapted for use as an underwater light.

11. The system of claim 1, wherein:
said system is adapted for use as in a swimming pool.

12. The system of claim 1, wherein:
said housing is substantially transparent.

13. The system of claim 1, wherein:
one of said threaded ends of said center shaft is adapted to be coupled to an eye nut, said eye nut adapted for lifting, hanging, or mounting said system.

14. The system of claim 1, wherein:
one of said threaded ends of said center shaft is adapted to be coupled to a hook adapted for lifting, hanging, or mounting said system.

15. The system of claim 1, wherein:
one of said threaded ends of said center shaft is adapted to be coupled to a pedestal plate, said pedestal plate adapted for vertical positioning said system on a substantially flat surface.

16. The system of claim 1, wherein:
said system is adapted for use in confined spaces.

17. The system of claim 1, wherein:
said system is adapted for use as outdoor lighting.

* * * * *